US008078441B2

(12) United States Patent
Greiner et al.

(10) Patent No.: US 8,078,441 B2
(45) Date of Patent: Dec. 13, 2011

(54) SYSTEMS AND METHODS FOR DESIGNING A HAUL ROAD

(75) Inventors: Jonny Ray Greiner, Dunlap, IL (US); Yang Liu, Dunlap, IL (US); Bhavin Jagdishbhai Vyas, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 1035 days.

(21) Appl. No.: 11/974,378

(22) Filed: Oct. 12, 2007

(65) Prior Publication Data

US 2009/0099708 A1 Apr. 16, 2009

(51) Int. Cl.
*G06G 7/48* (2006.01)

(52) U.S. Cl. ..... 703/7; 404/82; 404/96; 701/213; 701/215

(58) Field of Classification Search ..... 703/6, 7, 703/8; 404/109, 96, 82
See application file for complete search history.

(56) References Cited

U.S. PATENT DOCUMENTS

| | | | | |
|---|---|---|---|---|
| 5,610,821 | A | 3/1997 | Gazis et al. | |
| 5,719,771 | A | 2/1998 | Buck et al. | |
| 5,736,939 | A * | 4/1998 | Corcoran | 340/905 |
| 5,817,936 | A | 10/1998 | Schricker | |
| 6,246,932 | B1 | 6/2001 | Kageyama et al. | |
| 6,611,755 | B1 | 8/2003 | Coffee et al. | |
| 6,622,087 | B2 | 9/2003 | Anderson | |
| 6,650,995 | B2 | 11/2003 | Bullock | |
| 6,654,684 | B2 | 11/2003 | Shinada et al. | |
| 6,865,484 | B2 | 3/2005 | Miyasaka et al. | |
| 6,950,740 | B1 | 9/2005 | Cook | |
| 6,965,325 | B2 | 11/2005 | Finnern | |
| 7,113,127 | B1 | 9/2006 | Banet et al. | |
| 7,155,321 | B2 | 12/2006 | Bromley et al. | |
| 2002/0010569 | A1 * | 1/2002 | Yamamoto | 703/6 |
| 2002/0049523 | A1 | 4/2002 | Diaz et al. | |
| 2004/0039520 | A1 | 2/2004 | Khavakh et al. | |
| 2004/0122580 | A1 * | 6/2004 | Sorrells | 701/80 |
| 2005/0085973 | A1 * | 4/2005 | Furem et al. | 701/50 |
| 2005/0171692 | A1 | 8/2005 | Hamblen et al. | |
| 2006/0036363 | A1 | 2/2006 | Crook | |
| 2006/0161335 | A1 | 7/2006 | Beinhaker | |
| 2007/0016363 | A1 | 1/2007 | Huang et al. | |
| 2007/0078579 | A1 | 4/2007 | Schricker et al. | |

FOREIGN PATENT DOCUMENTS

| | | |
|---|---|---|
| AU | 2007100806 | 9/2007 |
| CA | 2541935 | 10/2007 |

OTHER PUBLICATIONS

Filla, An Event-driven Operator Model for Dynamic Simulation of Construction Machinery, Aug. 2005, pp. 1-20.*

Minnesota Department of Transportation, Simulating Trucks in CORSIM, Sep. 13, 2004, Minnesota Department of Transportation, pp. 1-24.*

* cited by examiner

*Primary Examiner* — Paul Rodriguez
*Assistant Examiner* — Bernard E Cothran
(74) *Attorney, Agent, or Firm* — Finnegan, Henderson, Farabow, Garrett & Dunner LLP

(57) ABSTRACT

A method for designing a haul road based on machine performance comprises receiving one or more haul road parameters and identifying at least one type of machine to be operated on the haul road. The method also includes selecting at least one target operating parameter associated with the at least one type of machine and simulating performance of the at least one type of machine to predict an operating value corresponding with the at least one target operating parameter. If the predicted operating value is not within a threshold range of the corresponding target operating parameter, one or more haul road parameters are adjusted.

23 Claims, 4 Drawing Sheets

SYSTEMS AND METHODS FOR DESIGNING A HAUL ROAD

TECHNICAL FIELD

The present disclosure relates generally to the design of haul roads and, more particularly, to systems and methods for designing haul roads based on performance of machines to be operated thereon.

BACKGROUND

Haul road design is an important aspect in the efficiency and productivity of many work environments. Poor haul road design, particularly in work environments that employ heavy machinery, not only results in slow and inefficient performance of the machines operating on the road, but may potentially cause undue stress and strain on machine drive train components, which may be particularly damaging for machines carrying heavy payloads.

Before the widespread use of computers, haul road design was a relatively intensive, manual process that required the expertise of highly-trained engineering professionals and construction personnel to ensure that the design was structurally sound. This design process was not only labor and time-intensive, but was also quite expensive, as many man-hours were required to create the design and verify the conformance of the design with all of the requisite standards and regulations.

After the development of the computer, specialized computer aided design (CAD) software programs provided engineers and construction professionals with tools that aided in the design of haul roads. By leveraging the processing power of the computer, many of these CAD programs were able to perform the complex structural calculations associated with the design within a matter of seconds. Not only did these CAD programs result in significant time savings, they reduced the potential for human error associated with manual calculation techniques, resulting in a more reliable design.

In addition to efficient performance of many processing and calculation functions, these CAD tools also provided an interface that aided in the layout of the haul routes, creation of the haul road blueprints and construction packages, and testing/analyzing the haul road design prior to construction. While these conventional CAD tools greatly simplified haul road design by providing a solution that performed many of the requisite peripheral functions after the design of the haul road, such as analysis, mapping, and drafting of the design, they were not sophisticated enough to create or develop the haul road design. Thus, in order to reduce reliance on complicated and highly-specialized manual haul road design techniques an interactive software tool for generating a haul road design based on user-defined design parameters may be required.

At least one such interactive road design software tool is described in U.S. Patent Application Publication No. 2002/0010569 ("the '569 publication") to Yamamoto. The '569 publication describes a software-based road design system that receives user-defined design conditions, generates a road design in accordance with the design conditions and any applicable roadway design rules and standards, and outputs a three-dimensional computer-generated rendering of the road design. The software-based road design system may also be networked with a plurality of client systems, allowing a plurality of users to access and operate the design system via the Internet or other shared communication network.

Although some conventional roadway design tools, such as the one described in the '569 publication, may provide a software system for generating a roadway design based on user-defined roadway design parameters, they may have several disadvantages. For example, conventional software design systems may not take into account specific performance parameters of individual machines or groups of machines in the roadway design. Because many types of heavy machines have specific zones of operation where they perform most efficiently, haul roads designed by conventional systems that do not take performance of the machines into account may limit the efficiency and productivity of the machine.

Moreover, many work environments may require haul roads that are designed to meet specific performance objectives. For example, in mine environments where fuel consumption is a concern due to elevated fuel prices and/or emission standards, it may be advantageous to design a haul road that is conducive to minimizing fuel consumption for machines operated on the haul road. However, because many conventional roadway design systems, including the system described in the '569 publication, may not take into account specific performance parameters of individual machines or groups of machines, haul road designers may not be able to determine whether a road design is effective at meeting the desired fuel consumption requirements for a particular group of machines.

The presently disclosed systems and methods for designing a haul road are directed toward overcoming one or more of the problems set forth above.

SUMMARY

In accordance with one aspect, the present disclosure is directed toward a method for designing a haul road based on machine performance. The method may comprise receiving one or more haul road parameters and identifying at least one type of machine to be operated on the haul road. At least one target operating parameter associated with the at least one type of machine may be selected and performance of the at least one type of machine may be simulated to predict an operating value corresponding with the at least one target operating parameter. The one or more haul road parameters may be adjusted if the predicted operating value is not within a threshold range of the corresponding target operating parameter.

According to another aspect, the present disclosure is directed toward a method for customizing an actual grade of a haul road based on performance data associated with one or more machines to be operated on the haul road. The method may comprise defining a target operating parameter for the at least one machine and simulating performance of the at least one machine by varying a total effective grade value associated with the at least one machine to generate a predicted operating value for the target operating parameter based on the simulation. A total effective grade value that causes the predicted operating value to fall within a threshold range of the target operating parameter may be identified, and an actual grade associated with the total effective grade value may be determined. The method may also include generating a haul road design summary that includes one or more of simulated performance results and actual grade data.

In accordance with yet another aspect, the present disclosure is directed toward a haul route management system. The system may include an input device configured to receive one or more haul road parameters from a subscriber and receive performance data associated with at least one type of machine to be operated on the haul road. The system may also include a performance simulator communicatively coupled to the input device. The performance simulator may be configured to establish a threshold range corresponding to at least one target operating parameter for the at least one type of machine and generate an initial haul road design based on one or more of the initial haul road parameters and the at least one target operating parameter. The performance simulator may also be configured to simulate performance of the at least one type of machine using the initial haul road design to predict an operating value corresponding with each of the at least one target operating parameter. The one or more haul road parameters may be adjusted to produce a second haul road design if the predicted operating value is not within the threshold range of the corresponding target operating parameter.

DETAILED DESCRIPTION

Figure 1:
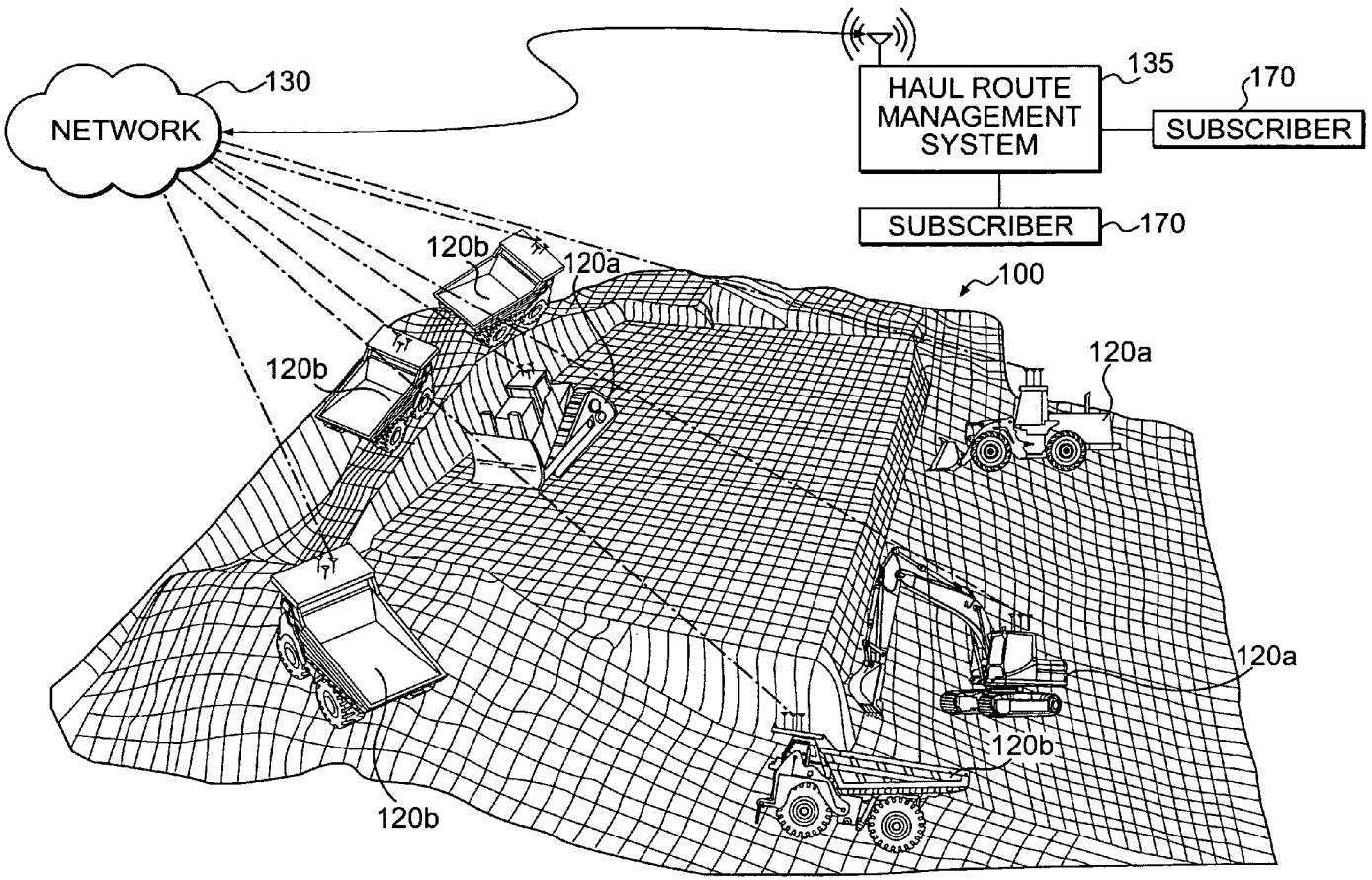
FIG. 1 illustrates an exemplary work environment consistent with the disclosed embodiments.

FIG. 1 illustrates an exemplary work environment 100 consistent with the disclosed embodiments. Work environment 100 may include systems and devices that cooperate to perform a commercial or industrial task, such as mining, construction, energy exploration and/or generation, manufacturing, transportation, agriculture, or any task associated with other types of industries. According to the exemplary embodiment illustrated in FIG. 1, work environment 100 may include a mining environment that comprises one or more machines 120*a*, 120*b* coupled to a haul route management system 135 via a communication network 130. Work environment 100 may be configured to monitor, collect, and filter information associated with the status, health, and performance of one or more machines 120*a*, 120*b*, and distribute the information to one or more back-end systems or entities, such as haul route management system 135 and/or subscribers 170. It is contemplated that additional and/or different components than those listed above may be included in work environment 100.

As illustrated in FIG. 1, machines 120*a*, 120*b* may include one or more excavators 120*a* and one or more transport machines 120*b*. Excavators 120*a* may embody any machine that is configured to remove material from the mine and load the material onto one or more transport machines 120*b*. Non-limiting examples of excavators 120*a* include, for example, bucket-type excavating machines, electromagnetic-lift devices, backhoe loaders, dozers, etc. Transport machines 120*b* may embody any machine that is configured to transport materials within work environment 100 such as, for example, articulated trucks, dump trucks, or any other truck adapted to transport materials. The number, sizes, and types of machines illustrated in FIG. 1 are exemplary only and not intended to be limiting. Accordingly, it is contemplated that work environment 100 may include additional, fewer, and/or different components than those listed above. For example, work environment 100 may include a skid-steer loader, a track-type tractor, material transfer vehicle, or any other suitable fixed or mobile machine that may contribute to the operation of work environment 100.

Figure 2:
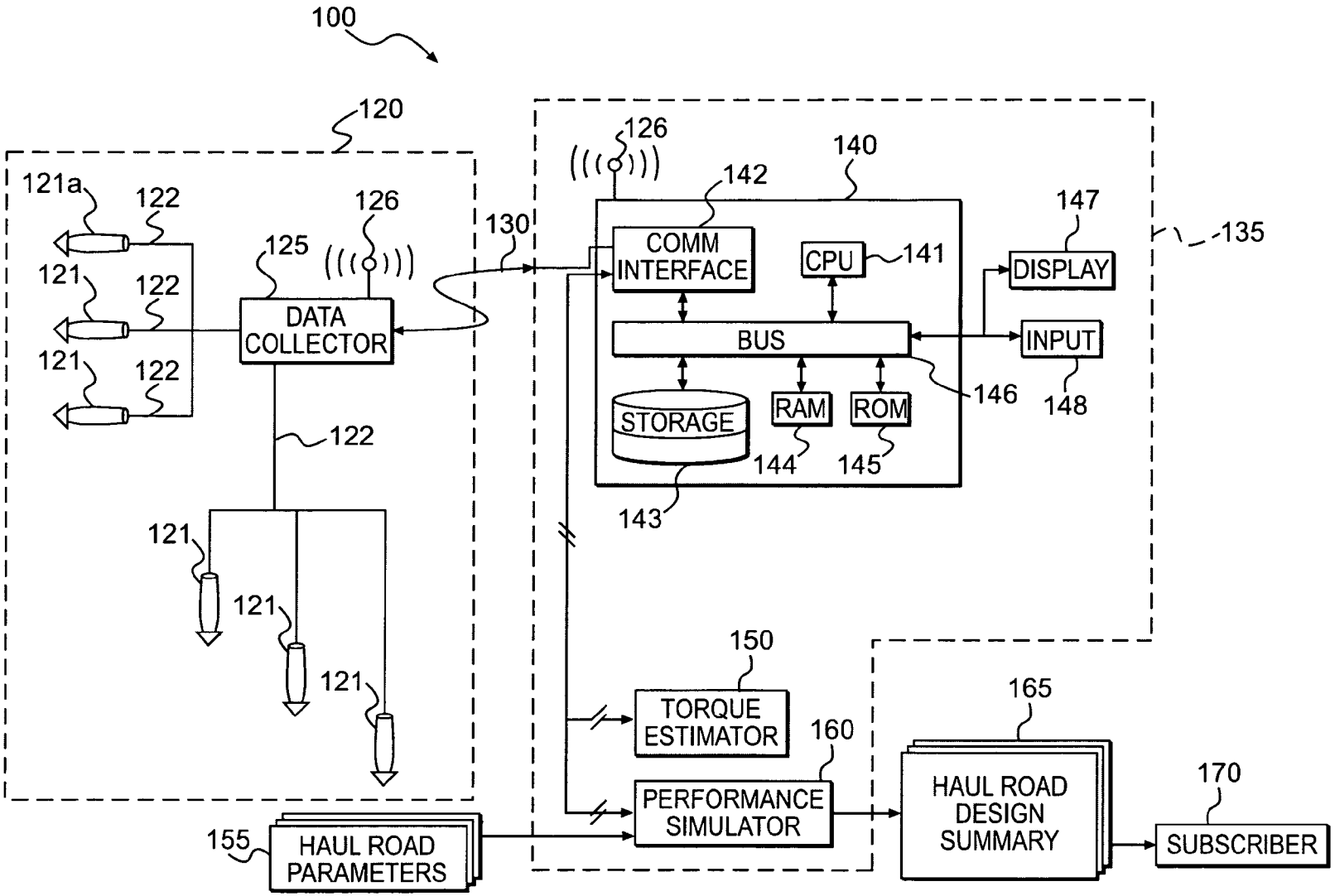
FIG. 2 provides a schematic diagram illustrating certain components associated with the work environment of FIG. 1.

In one embodiment, each of machines 120*a*, 120*b* may include on-board data collection and communication equipment to monitor, collect, and/or distribute information associated with one or more components of machines 120*a*, 120*b*. As shown in FIG. 2, machines 120*a*, 120*b* may each include, among other things, one or more monitoring devices 121, such as sensors or electronic control modules coupled to one or more data collectors 125 via communication lines 122; one or more transceiver devices 126; and/or any other components for monitoring, collecting, and communicating information associated with the operation of machines 120*a*, 120*b*. Each of machines 120*a*, 120*b* may also be configured to receive information, warning signals, operator instructions, or other messages or commands from off-board systems, such as a haul route management system 135. The components described above are exemplary and not intended to be limiting. Accordingly, the disclosed embodiments contemplate each of machines 120*a*, 120*b* including additional and/or different components than those listed above.

Monitoring devices 121 may include any device for collecting performance data associated with one or more machines 120*a*, 120*b*. For example, monitoring devices 121 may include one or more sensors for measuring an operational parameter such as engine and/or machine speed and/or location; fluid pressure, flow rate, temperature, contamination level, and or viscosity of a fluid; electric current and/or voltage levels; fluid (i.e., fuel, oil, etc.) consumption rates; loading levels (i.e., payload value, percent of maximum payload limit, payload history, payload distribution, etc.); transmission output ratio, slip, etc.; haul grade and traction data; drive axle torque; intervals between scheduled or performed maintenance and/or repair operations; and any other operational parameter of machines 120*a*, 120*b*.

In one embodiment, transport machines 120*b* may each include at least one torque sensor 121*a* for monitoring a torque applied to the drive axle. Alternatively, torque sensor 121*a* may be configured to monitor a parameter from which torque on the drive axle may be calculated or derived. It is contemplated that one or more monitoring devices 121 may be configured to monitor certain environmental features associated with work environment 100. For example, one or more machines 120*a*, 120*b* may include an inclinometer for measuring an actual grade associated with a surface upon which the machine is traveling. It is also contemplated that one or more monitoring devices 121 may be dedicated to the collection of machine location data. For example, machines 120*a*, 120*b* may each include GPS equipment for monitoring location data (e.g., latitude, longitude, elevation, etc.) associated with the machine.

Data collector 125 may be configured to receive, collect, package, and/or distribute performance data collected by monitoring devices 121. Performance data, as the term is used herein, refers to any type of data indicative of at least one operational aspect associated with one or more machines 120 or any of its constituent components or subsystems. Non-limiting examples of performance data may include, for example, health information such as fuel level, oil pressure, engine temperature, coolant flow rate, coolant temperature, tire pressure, or any other data indicative of the health of one or more components or subsystems of machines 120*a*, 120*b*. Alternatively and/or additionally, performance data may include status information such as engine power status (e.g., engine running, idle, off), engine hours, engine speed, machine groundspeed, machine location and elevation, current gear that the machine is operating in, or any other data indicative of a status of machine 120. Optionally, performance data may also include certain productivity information such as task progress information, load vs. capacity ratio, shift duration, haul statistics (weight, payload, etc.), fuel efficiency, or any other data indicative of a productivity of machine 120. Alternatively and/or additionally, performance data may include control signals for controlling one or more aspects or components of machines 120*a*, 120*b*. Data collector 125 may receive performance data from one or more monitoring devices via communication lines 122 during operations of the machine.

According to one embodiment, data collector 125 may automatically transmit the received data to haul route management system 135 via communication network 130. Alternatively or additionally, data collector 125 may store the received data in memory for a predetermined time period, for later transmission to haul route management system 135. For example, if a communication channel between the machine and haul route management system 135 becomes temporarily unavailable, the performance data may be retrieved for subsequent transmission when the communication channel has been restored.

Communication network 130 may include any network that provides two-way communication between machines 120*a*, 120*b* and an off-board system, such as haul route management system 135. For example, communication network 130 may communicatively couple machines 120*a*, 120*b* to haul route management system 135 across a wireless networking platform such as, for example, a satellite communication system. Alternatively and/or additionally, communication network 130 may include one or more broadband communication platforms appropriate for communicatively coupling one or more machines 120*a*, 120*b* to haul route management system 135 such as, for example, cellular, Bluetooth, microwave, point-to-point wireless, point-to-multipoint wireless, multipoint-to-multipoint wireless, or any other appropriate communication platform for networking a number of components. Although communication network 130 is illustrated as a satellite wireless communication network, it is contemplated that communication network 130 may include wireline networks such as, for example, Ethernet, fiber optic, waveguide, or any other type of wired communication network.

Haul route management system 135 may include one or more hardware components and/or software applications that cooperate to improve performance of a haul route by monitoring, analyzing, optimizing, and/or controlling performance or operation of one or more individual machines. Haul route management system 135 may include a condition monitoring system 140 for collecting, distributing, analyzing, and/or otherwise managing performance data collected from machines 120*a*, 120*b*. Haul route management system 135 may also include a torque estimator 150 for determining a drive axle torque, estimating a total effective grade, calculating a rolling resistance, and/or determining other appropriate characteristics that may be indicative of the performance of a machine or machine drive train. Haul route management system 135 may also include a performance simulator 160 for simulating performance-based models of machines operating within work environment 100 and adjusting operating parameters of machines 120*a*, 120*b* and/or physical features of the haul route to improve work environment productivity.

Condition monitoring system 140 may include any computing system configured to receive, analyze, transmit, and/or distribute performance data associated with machines 120*a*, 120*b*. Condition monitoring system 140 may be communicatively coupled to one or more machines 120 via communication network 130. Condition monitoring system 140 may embody a centralized server and/or database adapted to collect and disseminate performance data associated with each of machines 120*a*, 120*b*. Once collected, condition monitoring system 140 may categorize and/or filter the performance data according to data type, priority, etc. In the case of critical or high-priority data, condition monitoring system 140 may be configured to transmit "emergency" or "critical" messages to one or more work site personnel (e.g., repair technician, project managers, etc.) identifying machines that have experienced a critical event. For example, should a machine become disabled, enter an unauthorized work area, or experience a critical engine operation condition, condition monitoring system 140 may transmit a message (text message, email, page, etc.) to a project manager, job-site foreman, shift manager, machine operator, and/or repair technician, indicating a potential problem with the machine.

Condition monitoring system 140 may include hardware and/or software components that perform processes consistent with certain disclosed embodiments. For example, as illustrated in FIG. 2, condition monitoring system 140 may include one or more transceiver devices 126; a central processing unit (CPU) 141; a communication interface 142; one or more computer-readable memory devices, including storage device 143, a random access memory (RAM) module 144, and a read-only memory (ROM) module 145; a display unit 147; and/or an input device 148. The components described above are exemplary and not intended to be limiting. It is contemplated that condition monitoring system 140 may include alternative and/or additional components than those listed above.

CPU 141 may be one or more processors that execute instructions and process data to perform one or more processes consistent with certain disclosed embodiments. For instance, CPU 141 may execute software that enables condition monitoring system 140 to request and/or receive performance data from data collector 125 of machines 120*a*, 120*b*. CPU 141 may also execute software that stores collected performance data in storage device 143. In addition, CPU 141 may execute software that enables condition monitoring system 140 to analyze performance data collected from one or more machines 120*a*, 120*b*, perform diagnostic and/or prognostic analysis to identify potential problems with the machine, notify a machine operator or subscriber 170 of any potential problems, and/or provide customized operation analysis reports, including recommendations for improving machine performance.

CPU 141 may be connected to a common information bus 146 that may be configured to provide a communication medium between one or more components associated with condition monitoring system 140. For example, common information bus 146 may include one or more components for communicating information to a plurality of devices. CPU 141 may execute sequences of computer program instructions stored in computer-readable medium devices such as, for example, a storage device 143, RAM 144, and/or ROM 145 to perform methods consistent with certain disclosed embodiments, as will be described below.

Communication interface 142 may include one or more elements configured for two-way data communication between condition monitoring system 140 and remote systems (e.g., machines 120*a*, 120*b*) via transceiver device 126.

For example, communication interface 142 may include one or more modulators, demodulators, multiplexers, demultiplexers, network communication devices, wireless devices, antennas, modems, or any other devices configured to support a two-way communication interface between condition monitoring system 140 and remote systems or components.

One or more computer-readable medium devices may include storage devices 143, a RAM 144, ROM 145, and/or any other magnetic, electronic, flash, or optical data computer-readable medium devices configured to store information, instructions, and/or program code used by CPU 141 of condition monitoring system 140. Storage devices 143 may include magnetic hard-drives, optical disc drives, floppy drives, flash drives, or any other such information-storing device. A random access memory (RAM) device 144 may include any dynamic storage device for storing information and instructions by CPU 141. RAM 144 may store temporary variables or other intermediate information during execution of instructions to be executed by CPU 141. During operation, some or all portions of an operating system (not shown) may be loaded into RAM 144. In addition, a read only memory (ROM) module 145 may include any static storage device for storing information and instructions by CPU 141.

Condition monitoring system 140 may be configured to analyze performance data associated with each of machines 120*a*, 120*b*. According to one embodiment, condition monitoring system 140 may include diagnostic software for analyzing performance data associated with one or more machines 120*a*, 120*b* based on threshold levels (which may be factory set, manufacturer recommended, and/or user configured) associated with a respective machine. For example, diagnostic software associated with condition monitoring system 140 may compare an engine temperature measurement received from a particular machine with a predetermined threshold engine temperature. If the measured engine temperature exceeds the threshold temperature, condition monitoring system 140 may generate an alarm and notify one or more of the machine operator, job-site manager, repair technician, dispatcher, or any other appropriate person or entity.

In accordance with another embodiment, condition monitoring system 140 may be configured to monitor and analyze productivity associated with one or more of machines 120*a*, 120*b*. For example, condition monitoring system 140 may include productivity software for analyzing performance data associated with one or more machines 120*a*, 120*b* based on user-defined productivity thresholds associated with a respective machine. Productivity software may be configured to monitor the productivity level associated with each of machines 120*a*, 120*b* and generate a productivity report for a project manager, a machine operator, a repair technician, or any other entity that may subscribe to operator or machine productivity data (e.g., a human resources department, an operator training and certification division, etc.) According to one exemplary embodiment, productivity software may compare a productivity level associated with a machine (e.g., amount of material moved by a particular machine) with a predetermined productivity quota established for the respective machine. If the productivity level is less than the predetermined quota, a productivity notification may be generated and provided to the machine operator and/or project manager, indicating the productivity deficiency of the machine.

Condition monitoring system 140 may be in data communication with one or more other back-end systems and may be configured to distribute certain performance data to these systems for further analysis. For example, condition monitoring system 140 may be communicatively coupled to a torque estimator 150 and may be configured to provide performance data associated with the machine drive axle to torque estimator 150. Alternatively or additionally, condition monitoring system 140 may be in data communication with a performance simulator 160 and may be configured to provide performance data to performance simulator 160 for further analysis. Although torque estimator 150 and performance simulator 160 are illustrated as standalone systems that are external to condition monitoring system 140, it is contemplated that one or both of torque estimator 150 and performance simulator 160 may be included as a subsystem of condition monitoring system 140.

Torque estimator 150 may include a hardware or software module configured to receive/collect certain performance data from condition monitoring system 140 and determine, based on the received performance data, a drive axle torque associated with one or more machines 120*a*, 120*b*. Torque estimator 150 may be configured to determine a drive axle torque based on performance data collected by torque sensor 121*a*. Alternatively or additionally, drive axle torque may be estimated based on the performance data and the known design parameters of the machine. For example, based on an engine operating speed and the operating gear, torque estimator 150 may access an electronic look-up table and estimate the drive axle torque of the machine at a particular payload weight using the look-up table.

Once an estimated machine drive axle torque is determined, torque estimator 150 may estimate a total effective grade for the one or more machines. For example, torque estimator 150 may estimate a total effective grade (TEG) value as:

$$TEG = \frac{RP}{GMW} - \frac{MA}{AG} \quad \text{(Equation 1)}$$

where RP refers to machine rim pull, GMW refers to gross machine weight, MA refers to the acceleration of the machine, and AG refers to the actual grade of the terrain on which that machine is located. Gross machine weight and machine acceleration may be monitored using on-board data monitoring devices 121. Actual grade may be estimated based on monitored GPS data associated with the machine. For example, actual grade may be determined using based on latitude, longitude, and elevation of the machine derived from precision GPS data gathered from on-board GPS equipment. According to one embodiment, actual grade may be determined by calculating ratio between the vertical change in position (based on the elevation data associated with the GPS data) and the horizontal change in position (based on the latitude and longitude data associated with the GPS data). Alternatively or additionally, actual grade may be calculated using an on-board data monitoring device such as, for example, an inclinometer. Rim pull may be determined as:

$$RP = \frac{DAT \times LPTR \times PTE}{TDRR} \quad \text{(Equation 2)}$$

where DAT refers to the torque applied to the machine drive axle, LPTR refers to the lower power train reduction factor, PTE refers to the efficiency of the power train, and TDRR refers to the dynamic rolling radius of the tire. Lower power train reduction may be determined by monitoring a change in gear during real-time calculation of rim pull. Power train efficiency may be calculated based on real-time performance data collected from the machine. Tire dynamic rolling radius may be estimated based on a monitored tire pressure, speed, and gross machine weight.

Once total effective grade has been determined, torque estimator 150 may determine a rolling resistance associated with one or more of machines 120*a*, 120*b*. A rolling resistance value may be calculated as:

$$RR=TEG-(AG+EL) \quad \text{(Equation 3)}$$

where EL refers to the efficiency loss of the machine. Efficiency loss may be estimated as the difference between input power efficiency and output power efficiency, which may be estimated based on empirical test data at particular engine operating speeds and loading conditions. As explained, actual grade may be determined based on calculations associated with collected GPS data and/or monitored using an on-board inclinometer.

Performance simulator 160 may be configured to simulate performance of machines 120*a*, 120*b* under various operational or environmental conditions. Based on the simulated performance results, performance simulator 160 may determine one or more machine operating conditions (e.g., speed, gear selection, engine RPM, etc.) and/or haul road parameters (e.g., actual grade, rolling resistance, surface density, surface friction, etc.) to achieve a desired performance of machines 120*a*, 120*b* and/or work environment 100.

Performance simulator 160 may be any type of computing system that includes component or machine simulating software. The simulating software may be configured to build an analytical model corresponding to a machine or any of its constituent components based on empirical data collected from real-time operations of the machine. Once the model is built, performance simulator 160 may analyze the model under specific operating conditions (e.g., load conditions, environmental conditions, terrain conditions, haul route design conditions, etc.) and generate simulated performance data of the machine based on the specified conditions.

According to one embodiment, performance simulator 160 may include ideal design models associated with each of machines 120*a*, 120*b*. These ideal models can be electronically simulated to generate ideal performance data (i.e., data based on the performance of the machine as designed (under ideal operating conditions)). Those skilled in the art will recognize that, as a machine ages, components associated with the machine may begin to exhibit non-ideal behavior, due to normal wear, stress, and/or damage to the machine during operation. In order to provide more realistic performance simulations consistent with these non-idealities, the ideal models may be edited based on actual performance data collected from machines 120*a*, 120*b*, thus creating actual or empirical models of a respective machine and/or its individual components.

Performance simulator 160 may also include actual performance-based models associated with each of the machines 120*a*, 120*b*. Similar to the ideal design models described above, these performance-based models may be electronically simulated to predict performance and productivity of the machine under a variety of actual operating conditions. However, in contrast with the ideal models described above, performance simulator may be configured to generate the performance-based models based on specific operating conditions unique to each machine. Performance simulator 160 may simulate an actual model of hauler 120*b* under a variety of machine operating conditions to determine a speed, torque output, engine condition, fuel consumption rate, haul route completion time, etc. associated with each simulated condition. Alternatively or additionally, performance simulator 160 may be configured to simulate the actual model of hauler 120*b* under a variety of physical conditions (e.g., grade levels, friction levels, smoothness, density, hardness, moisture content, etc.) associated with the haul road surface to identify haul road parameters that cause the one or more machines to operate within a desired threshold operating range. As such, performance simulator 160 may provide mine operators and haul road designers a solution for customizing a haul road design based on actual performance data associated with one or more machines to be operated thereon.

Performance simulator 165 may be configured to receive haul road parameters 155 associated with perspective haul road design. For example, prior to the design of a haul road for a prospective mine environment, performance simulator 165 may receive one or more haul road parameters 155 from a subscriber 170. Haul road parameters 155 may include any parameter that may be used in designing the haul road such as, for example, a haul road start point (e.g., at an ore depository); a haul road stop point (e.g., at a transport or processing facility); an initial haul road grade; a preliminary haul road route; a haul road budget; or any other parameter that may be defined by subscriber 170 in designing the haul road.

Performance simulator 160 may be configured to allow users to simulate the ideal and/or performance-based software models corresponding with one or more machines under a variety of haul road design conditions. For example, using a software model associated with a hauler, performance simulator 160 may simulate operation of the hauler at multiple haul road grades by varying the total effective grade and/or rolling resistance that is presented to the hauler. Using the equations above, performance simulator may determine an actual grade corresponding to each total effective grade and/or rolling resistance value presented to the hauler and identify trends in machine performance based on road grades associated with one or more haul road designs. Subscribers 170 may select an actual grade for a haul road design by identifying the percent grade at which the simulated performance of the machine exhibits desired performance characteristics. For example, in mine environments where minimizing fuel consumption is a priority, performance simulator 160 may identify the haul road grade that causes the machine to consume the least amount of fuel. Alternatively and/or additionally, in mine environments where limiting machine maintenance and repair costs by prolonging component lifespan is critical, performance simulator 160 may identify the haul road grade that produces the least amount of stress and strain forces on the drive train of the machine.

In addition to haul road grade, performance simulator 160 may also be adapted to simulate operation of the hauler under other haul road conditions. For example, rolling resistance may be affected by tire and/or transmission slip, which may each depend upon haul road surface density, moisture level, and friction. Accordingly, performance simulator 160 may simulate performance of one or more machines by varying the rolling resistance level presented to the machine to identify a desired performance level of the machine.

Once a desired machine performance and rolling resistance value associated with the desired performance have been identified, performance simulator 160 may generate one or more haul road designs that comply with the desired machine performance and rolling resistance. For example, performance simulator 160 may specify a particular haul road surface density, friction, and maximum allowable moisture level for a haul road grade that cause the machine to meet the desired machine performance for a particular haul road grade. These parameters may be adjusted depending upon the desired grade level of the machine. Thus, as the grade level increases, thereby increasing the possibility of tire and/or transmission slip, the haul road surface density, friction, and maximum allowable moisture level may be adjusted to compensate for the grade level increase.

Performance simulator 160 may be configured to determine cost/benefit relationships between different haul road designs. For instance, increasing haul road grade may decrease the required length of the haul road, potentially reducing haul road construction and maintenance costs. Increasing the grade of the haul road, however, may result in increased machine maintenance and repair costs, due to the increased stress and strain that may be placed on the machine drive train. Furthermore, because tire and/or transmission slip may be more prevalent on steeper grades, savings in haul road construction costs as a result of the decreased length of the haul road may be offset by increases in costs associated with haul road adjustments aimed at reducing slip (e.g., by increasing haul road surface density, increasing haul road drainage to limit excess moisture in the soil, etc.) Performance simulator 160 may compile potential costs/benefits associated with each different haul road designs.

Performance simulator 160 may also include a diagnostic and/or prognostic simulation tool that simulates actual machine models (i.e., models derived or created from actual machine data) to predict a component failure and/or estimate the remaining lifespan of a particular component or subsystem of the machine. For example, based on performance data associated with the engine and/or transmission, performance simulator 160 may predict the remaining lifespan of the engine, drive train, differential, or other components or subsystems of the machine. Accordingly, performance simulator 160 may predict how changes in one or more haul road parameters may affect the lifespan of one or more of these components. For instance, performance simulator 160 may estimate that, if the grade of a particular haul road segment is reduced by 1.5%, thereby reducing the strain on the engine, transmission, and/or drive train, the remaining lifespan of the drive train may increase by 15%. Performance simulator 160 may periodically report this data to a mine operator, project manager, machine operator, and/or maintenance department of work environment 100.

According to one exemplary embodiment, one or more of condition monitoring system 140 and/or performance simulator 160 may be configured to monitor trends in performance data associated with portions of the haul route. For example, performance simulator 160 may be configured to monitor real-time total effective grade associated with one or more machines operating on a haul route. Using precision GPS data, performance simulator 160 may associate the real-time total effective grade data with a particular position of the machine when the total effective grade data was collected. Performance simulator 160 may be configured to identify trends in the monitored total effective grade data and correlate these trends with a particular portion of the haul route in order to identify potential problems with the haul route that may unnecessarily limit the performance of one or more machines.

According to another example, performance simulator 160 may be configured to detect performance deficiencies associated with one or more machines 120*a*, 120*b* due to haul road conditions by determining when machines 120*a*, 120*b* perform an excessive number of gear changes during haul route operations. Performance simulator 160 may be configured to monitor and record the number of gear changes (e.g., downshifts, upshifts, etc.) associated with one or more machines 120*a*, 120*b* corresponding with particular portions of the haul route. Performance simulator 160 may be configured to calculate an average number of gear changes associated with one or more haul route segments. Performance simulator 160 may identify segments of the haul route having an average number of gear changes that exceeds a threshold acceptable level, for further performance simulation and/or analysis.

Performance simulator 160 may be configured to output results of the performance simulation(s) and/or haul road design data. For example, performance simulator 160 may output performance simulation results and/or haul road design data via display 147 associated with condition monitoring system 140. Alternatively and/or additionally, performance simulator 160 may generate a haul road design summary 165 associated with work environment 100. Haul road design summary 165 may include performance simulation results corresponding to the different total effective grade levels and/or rolling resistance values using during the simulations. Haul road design summary 165 may also include any cost/benefit data for each haul road design compiled by performance simulator 165. The cost/benefit data may be based on historic or data gathered from previous haul road design projects. Performance simulator 160 may be configured to distribute haul road design summary 165 to one or more subscribers 170.

Performance simulator 160 may provide haul road design summary 165 to one or more designated subscribers 170 of haul route design data. Subscribers 170 may include, for example, haul road design customers such as project managers, mine owners, or any other person or entity that may be designated to receive haul road design summary 165.

It is contemplated that one or more of condition monitoring system 140, torque estimator 150, and/or performance simulator 160 may be included as a single, integrated software package or hardware system. Alternatively or additionally, these systems may embody separate standalone modules configured to interact or cooperate to facilitate operation of one or more of the other systems. For example, while torque estimator 150 is illustrated and described as a standalone system, separate from performance simulator 160, it is contemplated that torque estimator 150 may be included as a software module configured to operate on the same computer system as performance simulator 160.

Figure 3:
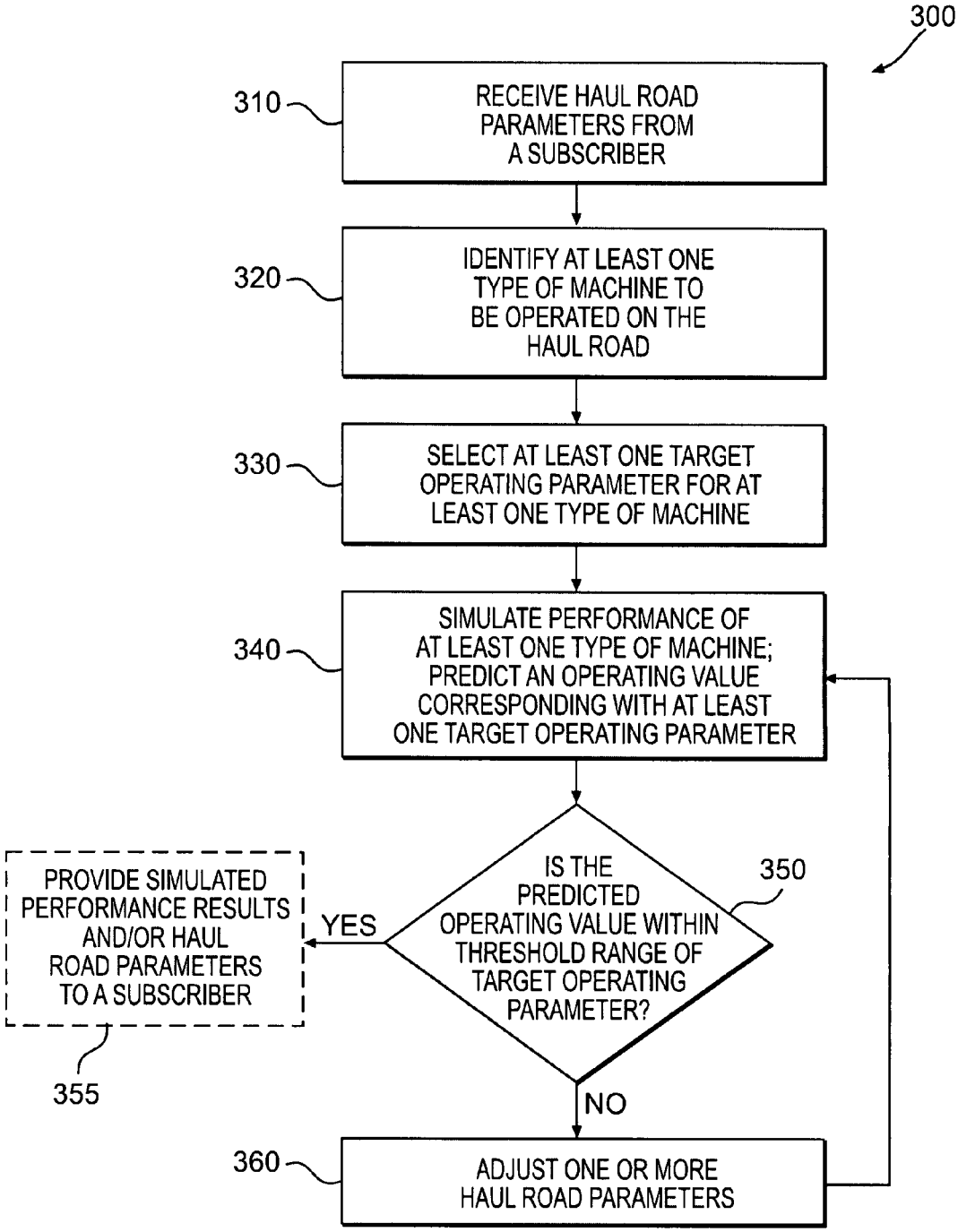
FIG. 3 provides a flowchart depicting an exemplary method for designing a haul road based on simulated performance of one or more machines to be operated on the haul road, consistent with certain disclosed embodiments.
Figure 4:
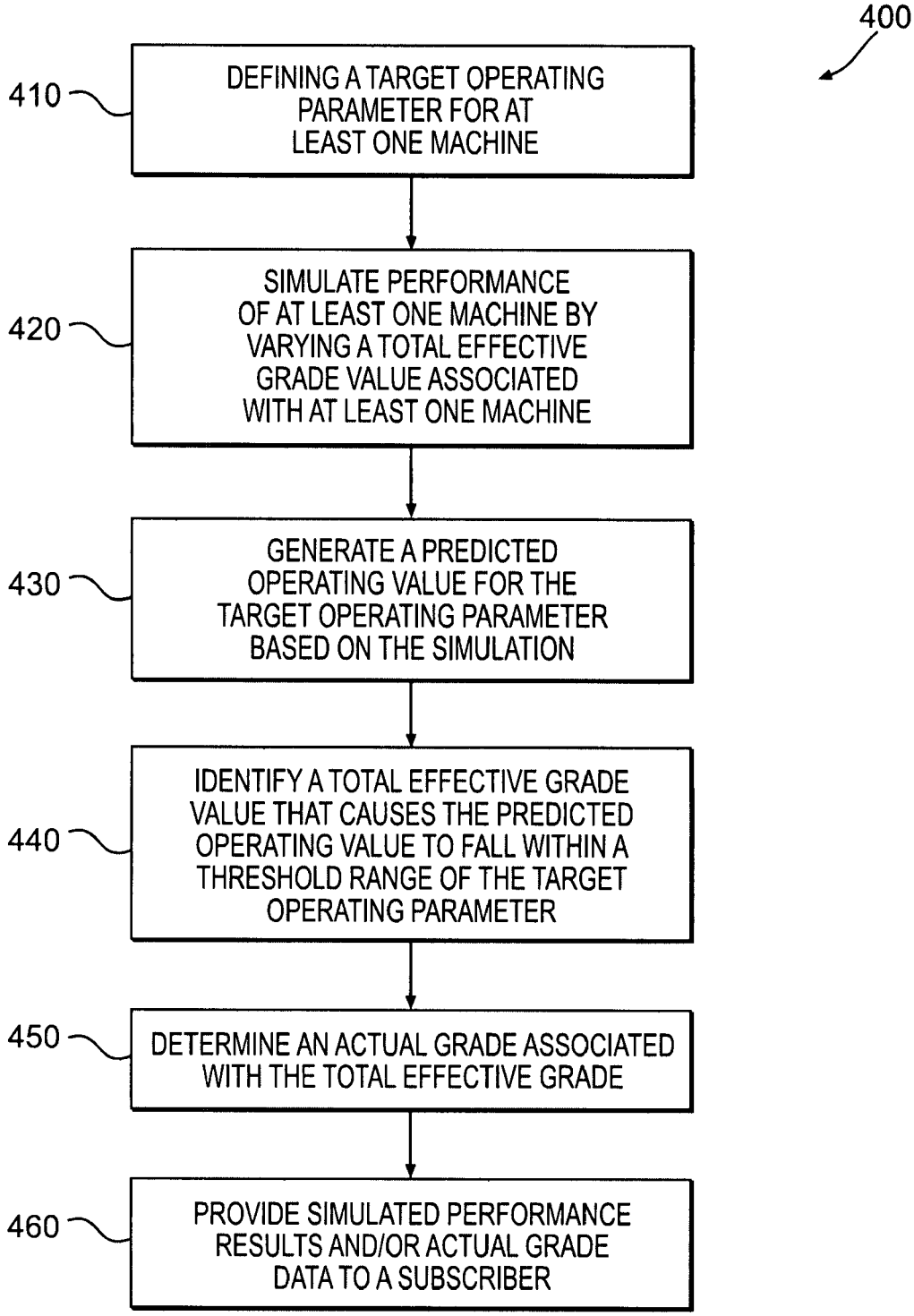
FIG. 4 provides a flowchart depicting an exemplary embodiment for customizing a haul road grade based on performance data collected from one or more machines to be operated on the haul road, consistent with certain disclosed embodiments.

Processes and methods consistent with the disclosed embodiments may provide an interactive solution that leverages data collection capabilities of a connected worksite with machine performance simulation software to design a haul road based on performance of one or more machines to be operated on the haul road. The presently disclosed haul road design system may provide a solution that allows mine operators to customize a haul road design based on certain desired design priorities as well as the specific operating characteristics of machines to be operated on the haul road. As a result, mine operators that employ the systems and methods described herein may tailor haul road designs to more effectively meet specific machine performance and haul route productivity goals. FIGS. 3 and 4 illustrate flowcharts 300 and 400, respectively, each depicting an exemplary method for haul road design that may be implemented using haul road management system 135.

FIG. 3 illustrates a flowchart 300 depicting an exemplary method for designing a haul road based on machine performance. The method may commence upon receipt of haul road parameters 155 from subscriber 170 (Step 310). According to one embodiment, performance simulator 160 may provide an interface that allows subscriber 170 to enter or define one or more haul road parameters. Performance simulator 160 may provide a graphical interface that includes an interactive checklist of one or more popular haul road design parameters that may be selected by the user. As noted above, haul road parameters may include any desired parameter associated with the design of the haul road. Non-limiting examples of haul road parameters include GPS coordinates associated with a haul road start point or stop point, an initial haul road grade, a preliminary haul road route and/or length, a haul road budget, a haul road completion time associated with the one or more machines, or any other parameter that may be defined by subscriber 170 in designing the haul road.

Performance simulator 160 may be configured to generate an initial haul road design based on the initial haul road parameters provided by subscriber 170. For example, based on the GPS data corresponding with the haul road starting and stopping points, performance simulator 160 may generate an initial haul road design. The initial haul road design may include an initial haul road grade, route, length, surface density, soil moisture level, average operating speed, etc. This initial haul road design may serve as the starting point for the haul road design simulations.

Once one or more desired haul road parameters have been defined, at least one type of machine to be operated on the haul road may be identified (Step 320). For example, performance simulator 160 may prompt the user to select a type and quantity of machines to be operated on the haul road from a list of machines commonly operated in mine environments. Alternatively, performance simulator 160 may allow subscriber 170 to identify one or more machines by uploading performance data associated with one or more actual machines to be operated on the haul road.

Performance simulator 160 may prompt a user to select at least one target operating parameter for each of the at least one machine to be operated on the haul road (Step 330). Target operating parameter, as the term is used herein, refers to any machine or haul road parameter whose value may be established as a benchmark for analyzing performance simulation results. For example, target operating parameter may include one or more of a fuel consumption level, greenhouse gas emission level, a route completion time, a component lifespan, a rolling resistance, a total effective grade, an engine speed, or a machine groundspeed. According to one embodiment, performance simulator 160 may provide a listing of performance parameters associated with each machine to subscriber 170. Subscriber 170 may select a one or more performance parameters of the machine, thereby designating the selected parameter as a target parameter within performance simulator 160. Subscriber 170 may establish a threshold acceptable range for each designated target parameter. These target parameters and associated threshold ranges may be used by performance simulator 160 as a designated convergence point during machine performance simulations to indicate that a desired machine or haul road performance condition has been met. For instance, a user may designate fuel consumption as the target operating parameter and specify a threshold acceptable range for the fuel consumption of the machine during operation on the haul road. Accordingly, performance simulator 160 may iteratively simulate machine performance and adjust haul road design parameters until haul road parameters have been selected that cause the predicted fuel consumption rate fall within the threshold acceptable range.

Once target parameters and threshold ranges associated with the target parameters have been established, performance simulator 160 may simulate performance of the machines selected to be operated on the haul road and predict an operating value corresponding with each target operating parameter (Step 340). Following the example above, performance simulator 160 may simulate the performance of the one or more machines under the initial haul road design parameters and predict a fuel consumption rate associated with each of the machines to be operated on the haul road.

Performance simulator may compare the predicted operating value with target operating parameter to determine whether the haul road design parameters are conducive to achieving the desired performance of the machines and/or haul route (Step 350). Specifically, if the predicted operating value corresponding with each of the target operating parameters is within the threshold range defined by subscriber 170, indicating that the selected haul road parameters conform to the user-defined performance parameters, performance simulator 160 may provide the simulated performance results and/or haul road parameters to subscriber 170 (Step 355).

If, on the other hand, the predicted operating value corresponding with the target operating parameter does not fall with the designated threshold range, indicating that the haul road design parameters may not meet the user-defined performance guidelines, performance simulator 160 may adjust one or more of the haul road design parameters (Step 360). According to one exemplary embodiment, performance simulator 160 may include adaptive convergence software that recognizes trends from past simulations and automatically determines which haul road parameter(s) may have the greatest impact on meeting the desired performance benchmarks. Once haul road parameters have been adjusted, the process may continue to Step 340 to re-simulate operation of the machines under the adjusted haul road design parameters. It is contemplated that Steps 340-360 may be repeated until the performance requirements associated with user-defined target parameters have been met.

FIG. 4 illustrates a flowchart 400 depicting an exemplary method for determining an actual grade associated with a haul road, based on actual performance data associated with one or more machines to be operated on the haul road. The method may comprise defining a target operating parameter for the at least one machine (Step 410). As noted above, performance simulator 160 may provide subscriber 170 with a list of operating parameters associated with a particular machine. Performance simulator 160 may detect one or more operating parameters selected by subscriber 170 and designate these parameters as target operating parameters. Performance simulator 160 may also prompt subscriber 170 to define a threshold range associated corresponding with each target operating parameter.

Once target operating parameters and corresponding threshold ranges have been defined, the performance of the at least one machine may be simulated (Step 420). According to one exemplary embodiment, performance simulator 160 may simulate performance of the at least one machine by varying a total effective grade value presented to the at least one machine and monitor the performance of the machine at each simulated total effective grade value.

Performance simulator 160 may generate a predicted operating value for the target operating parameter based on the simulation (Step 430). For example, if subscriber 170 designated haul road drive train lifespan as the target operating parameter, performance simulator 160 may predict a drive train lifespan for each of the at least one machine based on the simulated performance of the respective machine.

Performance simulator 160 may identify a total effective grade value that causes the predicted operating value to fall within a threshold range of the target operating parameters (Step 440). Following the example above, performance simulator 160 may identify a total effective grade that causes the drive train lifespan to fall within a threshold lifespan range established by subscriber 170.

Once an acceptable total effective grade value has been identified, performance simulator 160 may determine/calculate an actual grade value that corresponds with the total effective grade value (Step 450). For example, using Equation 1, actual grade may be determined/calculated for a given total effective grade, machine weight, machine acceleration, and rim pull. Performance simulator 160 may subsequently generate haul road design summary 165 and provide the design summary to one or more subscribers 170 (Step 460). As explained, haul road design summary 165 may include simulated machine performance under a plurality of total effective grade values and actual grade data associated with each of the total effective grade values.

INDUSTRIAL APPLICABILITY

Methods and systems associated with the disclosed embodiments provide a solution for designing a haul road based on specific user-defined haul road parameters and performance goals. The systems and methods described herein also allow users to test proposed haul road modifications by simulating performance-based machine models to determine the effect of the haul road design on the performance of the machine(s). Work environments that employ the processes and features described herein provide a system that enables subscribers to define haul road parameters and efficiently create haul road designs based on the haul road parameters and actual machine performance data. As a result, each haul road design may be tailored to the specific machine performance goals of the subscriber based on the performance of the specific machines to be operated on the haul road.

Although the disclosed embodiments are described in relation to improving haul road conditions in mine environments, they may be applicable to any environment where it may be advantageous to design a roadway based on performance of the machines to be operated thereon. According to one embodiment, the presently disclosed system and method for improving haul road conditions may be implemented as part of a connected worksite environment that monitors performance data associated with a machine fleet and diagnoses potential problems with machines in the fleet. As a result, systems and methods described herein may provide an integrated system for monitoring performance of one or more machines and designing haul roads based on the performance of the specific machines to be operated on a haul road.

The presently disclosed systems and methods for designing a haul road may have several advantages. For example, the systems and methods described herein provide a solution for automatically generating and testing haul road designs based on performance data associated with one or more specific machines to be operated on the haul road. As a result, the haul road design may be specifically tailored to effectuate efficient performance of the one or more machines to be operated thereon.

In addition, the presently disclosed haul road design system may have significant cost advantages. For example, by simulating performance of one or more machines based on the designed haul road parameters, the presently disclosed system enables users to ensure that the proposed design meets target performance requirements before commencing construction of the haul road, when modifications of the design may significantly increase construction costs and delays.

It will be apparent to those skilled in the art that various modifications and variations can be made to the disclosed systems and methods for designing a haul road without departing from the scope of the disclosure. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. A method for designing a haul road based on machine performance, the method comprising:

receiving one or more haul road parameters;

identifying at least one type of machine to be operated on the haul road;

selecting at least one target operating parameter associated with the at least one type of machine;

simulating performance of the at least one type of machine to predict an operating value corresponding with the at least one target operating parameter; and adjusting the one or more haul road parameters if the predicted operating value is not within a threshold range of the corresponding target operating parameter.

2. The method of claim 1, further including outputting the simulated performance data.

3. The method of claim 1, wherein the one or more haul road parameters include one or more of a location of a haul road start point, a location of a haul road end point, a haul road grade, and a haul road rolling resistance.

4. The method of claim 1, wherein the at least one target operating parameter includes one or more of a fuel consumption level, a route completion time, a component lifespan, a rolling resistance, a total effective grade, an engine speed, or a machine groundspeed.

5. The method of claim 1, wherein simulating performance of the at least one type of machine includes:

generating an initial haul road design based on one or more of the initial haul road parameters and the at least one target operating parameter;

simulating performance of the at least one type of machine based on the initial haul road design to predict an operating value corresponding with the at least one target operating parameter; and generating a second haul road design if the predicted operating value is not within the threshold range of the corresponding target operating parameter.

6. The method of claim 1, wherein simulating performance of the at least one type of machine is based on actual performance data associated with the at least one least one type of machine.

7. The method of claim 1, wherein simulating performance of the at least one type of machine is based on design performance data associated with the at least one type of machine.

8. The method of claim 1, wherein identifying at least one type of machine to be operated on the haul road includes identifying one or more particular machines to be operated on the haul road.

9. The method of claim 8, wherein simulating performance of the at least one type of machine includes simulating performance of the one or more particular machines based on actual performance data associated with the one or more particular machines.

10. A method for customizing an actual grade of a haul road based on performance data associated with one or more machines to be operated on the haul road, the method comprising:

defining a target operating parameter for the at least one machine;

simulating performance of the at least one machine by varying a total effective grade value associated with the at least one machine to generate a predicted operating value for the target operating parameter based on the simulation;

identifying a total effective grade value that causes the predicted operating value to fall within a threshold range of the target operating parameter;

determining an actual grade associated with the total effective grade value; and generating a haul road design summary that includes one or more of simulated performance results and actual grade data.

11. The method of claim 10, wherein the at least one target operating parameter includes a fuel consumption level.

12. The method of claim 10, wherein the at least one target operating parameter includes a route completion time.

13. The method of claim 10, wherein the at least one target operating parameter includes a lifespan associated with one or more components of the at least one machine.

14. The method of claim 10, wherein the at least one target operating parameter includes a rolling resistance.

15. The method of claim 10, wherein the at least one target operating parameter includes an engine speed.

16. The method of claim 10, wherein the at least one target operating parameter includes a machine groundspeed.

17. A haul route management system, comprising:

an input device configured to:

receive one or more haul road parameters from a subscriber;

receive performance data associated with at least one type of machine to be operated on the haul road;

a performance simulator communicatively coupled to the input device and configured to:

establish a threshold range corresponding to at least one target operating parameter for the at least one type of machine;

generate an initial haul road design based on one or more of the haul road parameters and the at least one target operating parameter;

simulate performance of the at least one type of machine using the haul road design to predict an operating value corresponding with each of the at least one target operating parameter; and adjust the one or more haul road parameters to produce a second haul road design if the predicted operating value is not within the threshold range of the corresponding target operating parameter.

18. The system of claim 17, wherein the performance simulator is further configured to provide one or more of simulated performance results and the adjusted haul road parameters to the subscriber.

19. The system of claim 17, wherein the one or more haul road parameters include one or more of a location of a haul road start point, a location of a haul road end point, a haul road grade, and a haul road rolling resistance.

20. The system of claim 17, wherein the at least one target operating parameter includes one or more of a fuel consumption level, a route completion time, a component lifespan, a rolling resistance, a total effective grade, an engine speed, or a machine groundspeed.

21. The system of claim 17, wherein the performance simulator is further configured to:

simulate performance of the at least one type of machine using the second haul road design; and update the predicted operating value corresponding with each of the at least one target operating parameter based on the second haul road design.

22. The system of claim 17, wherein the performance simulator is configured to simulate performance of the at least one type of machine based on actual performance data associated with the at least one least one type of machine.

23. The system of claim 17, wherein the performance simulator is configured to simulate performance of the at least one type of machine based on design performance data associated with the at least one type of machine.

* * * * *